United States Patent [19]

Tsukamoto et al.

[11] Patent Number: 4,951,568

[45] Date of Patent: Aug. 28, 1990

[54] METHOD FOR MOUNTING PRINTING PLATE ON PRINTING PRESS

[75] Inventors: Koziro Tsukamoto, Kariya; Yuzo Tatsuno, Tokyo; Masaki Kubo, Tokyo; Yosio Kumano, Tokyo, all of Japan

[73] Assignee: Mitsubishi Paper Mills, Ltd., Tokyo, Japan

[21] Appl. No.: 197,958

[22] Filed: May 24, 1988

[30] Foreign Application Priority Data

May 25, 1987 [JP] Japan ..... 62-129421

[51] Int. Cl.[5] ..... B41F 1/28

[52] U.S. Cl. ..... 101/415.1; 101/378; 101/462

[58] Field of Search ..... 101/415.1, 378, 401.1, 101/460, 461, 462, 473; 493/63, 69, 79; 281/2, 5

[56] References Cited

U.S. PATENT DOCUMENTS

| | | | |
|---|---|---|---|
| 2,900,904 | 8/1959 | Hantscho | 101/415.1 |
| 4,212,231 | 7/1980 | Penick et al. | 156/227 X |
| 4,540,612 | 9/1985 | Rhyner | 281/2 X |
| 4,631,046 | 12/1986 | Kennedy | 493/63 X |
| 4,643,093 | 2/1987 | Goar et al. | 101/415.1 X |
| 4,735,437 | 4/1988 | Fattibene | 281/5 X |

*Primary Examiner*—Edgar S. Burr
*Assistant Examiner*—Ren Yan
*Attorney, Agent, or Firm*—Cushman, Darby & Cushman

[57] ABSTRACT

Disclosed is a method for mounting a printing plate having a paper or synthetic resin film as a support on an offset rotary printing press by inserting both ends of the printing plate into a holding slit of printing cylinder and a slit of a gripping rod which comprises previously folding the printing plate at the positions in both end parts of the printing plate which correspond to the positions of the holding slit of the printing cylinder and the slit of the gripping rod, respectively, to form hooked portions to be inserted into the slits, inserting one end portion of the printing plate into the holding slit of the printing cylinder and another hooked portion of the printing plate into the slit of the gripping rod and fixing the printing plate on the printing cylinder by stretching the printing plate by rotating the gripping rod, wherein perforations are previously made along which the printing plate is folded and the printing plate is folded along the perforations when the printing plate is mounted on the rotary printing press and/or said gripping rod is subjected to surface-working in at least in the portion which contacts with the printing plate to provide this portion with frictional force.

9 Claims, 3 Drawing Sheets

METHOD FOR MOUNTING PRINTING PLATE ON PRINTING PRESS

BACKGROUND OF THE INVENTION

This invention relates to a method for mounting a printing plate on an offset rotary press and more particularly, it relates to a method for stably fixing a printing plate having a paper or a synthetic resin film as a support on a printing cylinder provided with a gripping rod which is fitted in a groove. This method is especially suitable for printing machines for printing business forms.

A representative printing plate used for printing on offset rotary presses is the so-called presensitized plate (PS plate) having an aluminum plate as support. However, the steps for making PS plates are complicated and recently, printing plates made by direct plate-making methods such as silver salt type and electrophotographic type have become popular.

In these printing plates, normally papers, both-side resin coated papers and synthetic resin films are used as supports for purpose of cost reduction. There are problems that these printing plates using paper and synthetic resin film are not necessarily suitable for printing by printing presses designed to be used for printing with printing plates using an aluminum plate as a support.

For example, the offset rotary printing press with a printing cylinder having a gripping rod fitted in a groove as shown in FIG. 6 is one designed for printing with a PS plate and a printing plate using an aluminum plate as support can be mounted thereon without any problems, but printing plates using paper or a synthetic resin film as a support cannot be stably fixed on the cylinder.

As shown in FIG. 6, a thin oblong printing plate 2 is fixed on cylinder 1 by winding it round outer surface of the cylinder. In this case, hooked portions 3, 3 are formed at a front edge portion 5 and a rear edge portion 6 of the printing plate 2 by folding at the portion 4 (fold 4) and these hooked portions 3 and 3 are inserted into a holding slit 7 formed in cylinder 1 and wound round cylinder 1 through the gripping rod 8 and fixed thereto.

When the printing plate is mounted on the printing press, hooked portion 3 must be inserted into holding slit 7 of cylinder 1 as mentioned above and hence fold 4 must be previously formed.

In case the support for the printing plate is an aluminum plate, when the aluminum plate is folded at a desired angle by a force more than the elastic limit thereof, the plate is not restored to the original form and retains its folded state at the desired angle. Therefore, this printing plate can be fixed in close contact with the surface of the cylinder by binding with the gripping rod.

When the support is paper or a synthetic film and when the printing plate is folded at a desired angle, this folding angle is not retained due to the force for restoration to the original form and if it is attempted to bind the printing plate by means of the gripping rod, the printing plate slips out of the slit of the gripping rod and cannot be fixed on the printing cylinder.

Hitherto, printing plates using synthetic resin film as a support (referred to as "printing film plate" hereinafter) have been folded by heat or pressure or by a scribing knife.

When heat or pressure is employed, for example, as shown in FIG. 7, a printing film plate 2 is put on copy mold 9 which has the same width as the printing film plate and has tapering face 10 at both ends and both ends of the printing film plate are pressed in the directions of upper arrow a and lower arrow b by pressing means 12 and simultaneously the tapering face 10 is heated by heater 11 to fold the printing film plate. However, when the film plate is folded by this folding method, as shown in FIG. 8, the fold 4 is merely given a kink and sharp fold 4 cannot be formed and only an obtuse edge can be obtained. When printing film plate 2 having such fold 4 is mounted on a printing cylinder, since a convex part is formed at the folded portion, clear printed images cannot be obtained and besides the folding operation requires much time and the folding device is expensive.

Another method of folding with use of a scribing knife will be explained with reference to FIG. 9. According to this method, groove 14 is formed in both end portions of the film plate through the width by use of scribing knife 13 by an operator. However, it is very difficult to produce groove 14 uniform in depth and the plate is often cut off at that portion. Furthermore, depth of the groove at end portion, in other words, side portion is liable to become smaller while that of the center portion is liable to become greater because of non-uniform application of force.

Other methods to fold printing film plate are: One according to which a printing film plate is folded by a folding machine for a PS plate to form portions to be inserted into the holding slit of a printing cylinder or the slit of a gripping rod at both ends of the plate, namely, the hooked portions, a thin iron strip is applied to said hooked portions and these portions are inserted into the holding slit of printing cylinder and the slit of a gripping rod to prevent the printing film plate from slipping out of these slits and another one according to which an elastic thin iron strip is inserted into the slit of a gripping rod with it protruding therefrom together with one end of the printing film plate and another end portion of the printing film plate is inserted into the holding slit of the printing cylinder and is pressed by the protruded portion of said elastic iron strip by rotating the gripping rod thereby to prevent the printing film plate from slipping out of either slit. In both of these methods, the iron strip must be prepared in accordance with the size of the printing film plate and besides these iron strips must be applied to the plate or inserted into slit at each time of mounting the printing plate on printing cylinder. Thus, mounting operation is troublesome and operability is inferior.

A further method is to directly wind a printing plate round a printing cylinder using double-coated adhesive tape. However, the winding and fixing operation is troublesome and besides the printing plate may often be torn off during printing.

SUMMARY OF THE INVENTION

An object of this invention is to provide a method for mounting a printing plate on an offset rotary printing press by which a printing plate using paper, synthetic resin film or the like as a support can be stably fixed on a printing cylinder.

Another object of this invention is to provide a method for mounting a printing plate on an offset rotary printing press by which especially a printing plate using a synthetic resin film as a support can be easily and securely fixed on a printing cylinder.

Still another object of this invention is to provide a method for mounting a printing plate on an offset rotary printing press by which a printing plate can be easily and securely fixed on a printing cylinder provided with a gripping rod having a slit as mentioned above.

The above objects have been accomplished by providing the following methods: a method for mounting a printing plate having a synthetic resin film as a support on an offset rotary printing press by inserting both ends of the printing plate into a holding slit of a printing cylinder and a slit of a gripping rod which comprises previously folding the printing plate at the positions in both end parts of the printing plate which correspond to the positions of the holding slit of the cylinder and the slit of the gripping rod, respectively, to form hooked portions to be inserted into the slits, inserting one hooked portion of the printing plate into the holding slit of the cylinder and another hooked portion of the printing plate into the slit of the gripping rod and fixing the printing plate on the cylinder by stretching the printing plate by rotating the gripping rod, wherein perforations are previously made along which the printing plate is to be folded and the printing plate is folded along these perforations and/or a gripping rod subjected to surface-working at least in the portion which contacts with the printing plate for providing the portion with frictional force is used as the gripping rod.

One example of this invention will be explained in detail with reference to FIGS. 1–5.

Figure 6:
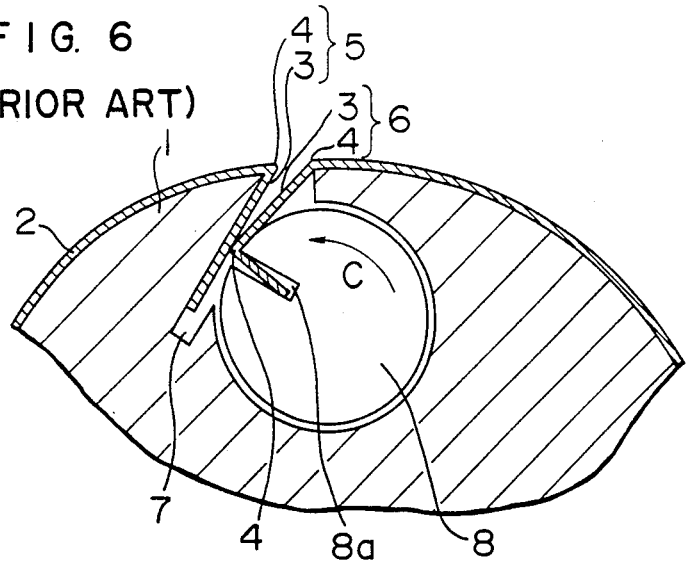
FIG. 6 (PRIOR ART)
FIG. 6 is a partially enlarged cross section which shows the state in which a printing film plate is fixed on a printing cylinder.

Since a printing cylinder and mechanism for mounting a printing plate thereon are the same as shown in FIG. 6, the same reference numbers are given to the same portions and explanations thereon are omitted.

Figure 1:
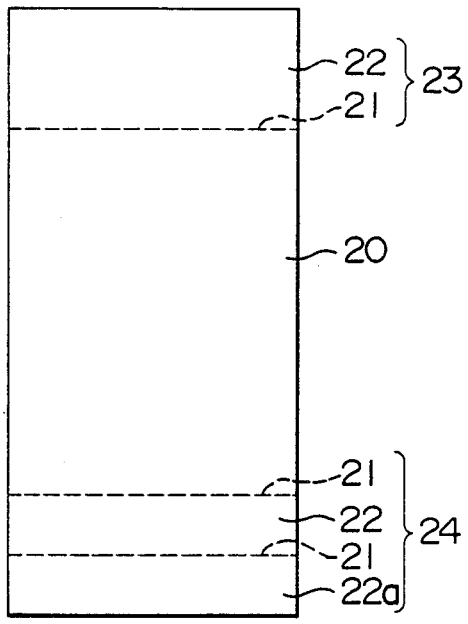
FIG. 1 is a plan view of the printing film plate according to this invention and FIG. 2 shows a partially enlarged cross section thereof.

FIG. 1 shows the first example of this invention. Printing film plate 20 comprising a polyester or the like can be folded at perforations 21 shown in FIG. 2 which are provided in front end portion 23 and rear end portion 24 of the printing film plate and thus hooked portions 22, 22 are formed in both end portions of the printing film plate. In addition, hooked portion 22*a* to be inserted into the slit of the gripping rod is formed in the rear end portion 24.

Figure 2:
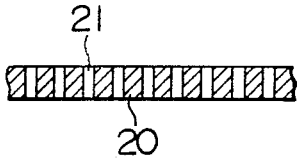
Figure 3:
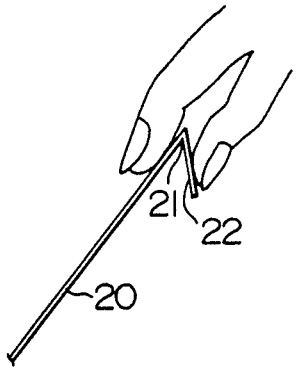
FIG. 3 shows how to fold the printing plate and FIG. 4 is an oblique view of a folded printing plate.
Figure 4:
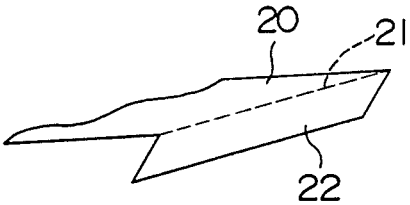

The perforation can be made by a rotary blade or a flat blade and the former is more efficient. In this example, the portion other than perforation 21 is continuous as shown in FIG. 2. Therefore, the printing plate can be easily folded at the perforation by fingers as shown in FIG. 3 and besides can be folded acutely as shown in FIG. 4 with no danger of it being cut off.

Figure 5:
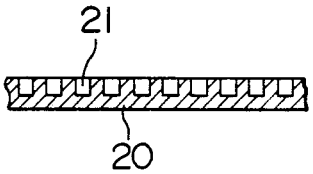
FIG. 5 shows a partially enlarged cross section of a printing plate of another example according to this invention.

FIG. 5 shows the second example where the perforation 21 is not completely perforated through the plate and is perforated to a half of the thickness. Such incomplete perforation can also be made preferably by a rotary blade by which perforation of uniform depth can be easily made. When such incomplete perforation is provided, the printing film plate has no completely perforated portions and there occurs no penetration of water. This is especially effective for offset printing.

As shown in FIG. 6, the hooked portions 22, 22 (corresponding to 3, 3) of printing film plate 20 (corresponding to 2) which are formed by folding at the perforation 21 are inserted into holding slit 7 provided in the printing cylinder 1 and simultaneously the hooked portion 22*a* is inserted into slit 8*a* of gripping rod 8. Then, the gripping rod 8 is rotated in the direction of arrow C, thereby to fix the printing film plate 20 (corresponding to 2) on printing cylinder 1.

As explained above, according to this invention, the printing film plate can be easily and acutely folded by the fingers because there are provided perforations in both end portions of the plate for folding along these perforations. Thus, operation of mounting the printing plate is very easy and besides printing accuracy can be improved. Furthermore, only perforation by a rotary blade or the like is necessary and so these printing film plates can be produced at low cost. In addition, there is no danger of cutting off of the printing plate.

This invention will be explained on another example with reference to FIGS. 11 and 12.

The printing cylinder and mechanism for mounting a printing plate thereon are identical with those as shown in FIG. 6 and hence the same reference numbers are used for the same portions and explanation thereof are omitted.

In another example of this invention, a gripping rod which has been subjected to surface-working in at least the portion which contacts with the printing plate to impart frictional force thereto is used to prevent the printing plate from a slipping due to rotation of the printing cylinder during printing, whereby fixing of a printing plate using paper or synthetic resin film as a support on a printing cylinder can be stably performed in any of the methods of this invention characterized in the folding method of the printing plate and other conventional methods of utilizing heat and pressure or a scribing knife for folding of a printing plate.

That is, this method uses a gripping rod having a slit for gripping the printing plate the surface of which is worked by knurling, coating with rubber and the like to impart a frictional force thereto. The rod has no limitation in shape and material as long as a printing plate can be fixed on a printing cylinder by inserting an end portion (normally the rear end portion) of the printing plate into the slit of the gripping rod.

FIGS. 11(*a*)–11*e*) shows examples of surface working 30 on gripping rod 8 wherein FIG. 11 (*a*) shows a gripping rod knurled on the whole surface and FIGS. 11(*b*)–(*d*) roughly show the pattern formed by the surface-working on the surface of the rod. The size of the pattern may be optionally chosen depending on the kind of printing plate. In FIG. 11(*e*), the whole surface of the gripping rod is coated with rubber. The material of the rubber is not critical as far as it has wear, resistance and solvent resistance.

Figure 12F:
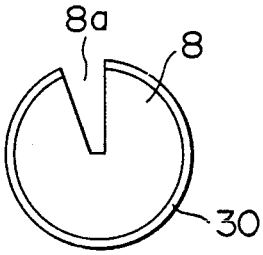
FIGS. 12(*c*) and 12(*g*) show side views of gripping rods which show the shape of the slit.
Figure 12G:
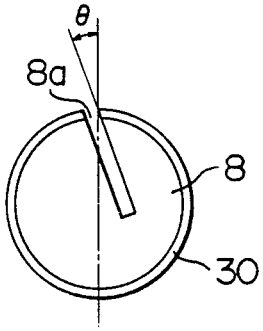

FIGS. 12(*f*) and 12(*g*) show shape of slit provided in the gripping rod for more effectively carrying out this invention which uses the surface-worked gripping rod. In FIG. 12(*f*), slit 8*a* has fan-like shape for easy insertion of the hooked portion of the printing plate. In FIG. 12(*g*), slit 8*a* is provided with an oblique angle of $\theta$ with axis for easy binding of printing plate. The oblique angle is preferably 20° or less, but is not critical as far as the slit is provided deviating from the axis of the rod to the right with an acute oblique angle as shown in FIG. 12(*g*).

Impartation of frictional force to the surface of the gripping rod 8 is enough to achieve the object of this invention and this invention should not be limited to the above embodiment. This rod 8 with frictional force on its surface can be used in any of the methods to achieve the object of this invention.

Figure 7:
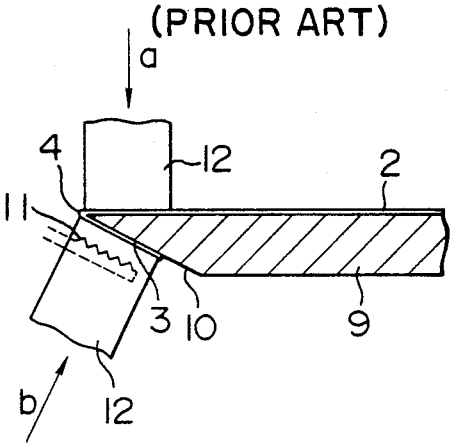
FIG. 7 (PRIOR ART)
FIGS. 7 and 8 are side views which show how to fold a printing plate according to a conventional method and the state of the thus folded printing plate, respectively.
Figure 8:
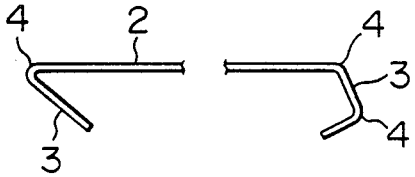
FIG. 8 (PRIOR ART)
Figure 9:
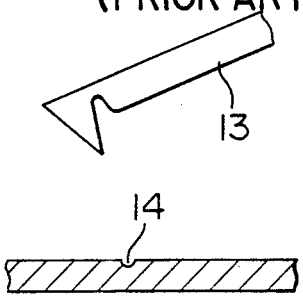
FIG. 9 (PRIOR ART)
FIGS. 9 and 10 are side views which show how to fold a printing plate according to another conventional method and the state of the thus folded printing plate.
Figure 10:
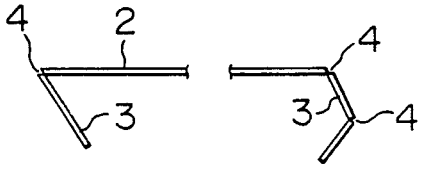
FIG. 10 (PRIOR ART)
Figure 11A:
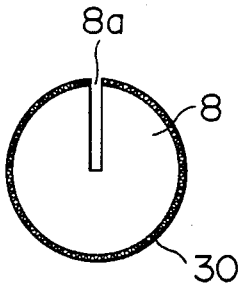
FIGS. 11(*a*)–11(*e*) show examples of gripping rods surface-worked according to this invention.
Figure 11B:
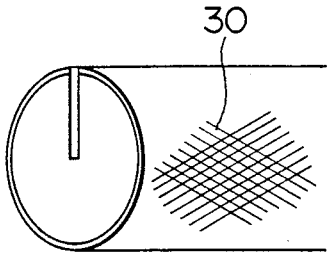
Figure 11E:
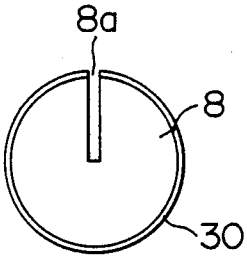
Figure 11C:
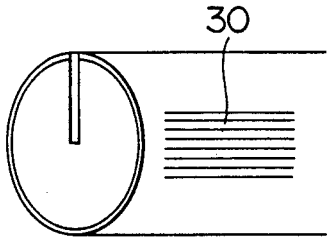
Figure 11D:
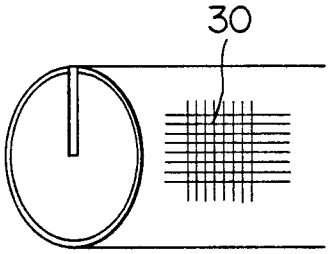

Thus, when the gripping rod subjected to knurl-working on the whole surface as shown in FIG. 11(*b*) is used in place of the gripping rod 8 shown in FIG. 6 and hooked portion 3 in front end portion 5 of printing film plate 2 having three folds 4 formed by the conventional folding method as shown in FIG. 7 at the same positions as those of perforations as shown in FIG. 1 is inserted into holding slit 7 and hooked portion 3 in rear end portion 6 of this printing film plate is inserted into the slit 8*a* of the gripping rod (FIG. 11(*b*)) and then the gripping rod is rotated in the direction of arrow C to fix the printing film plate 2 on printing cylinder 1 and printing was carried out, it was recognized that there occurred no problems and the printing film plate was able to be stably fixed.

That is, according to this invention, a printing plate having a paper or a synthetic resin film as a support can be stably fixed on a printing cylinder by using a surface-worked gripping rod for holding one end portion of the printing plate.

Furthermore, by the surface-working of gripping rod with specific patterns and with a specific material, the printing plate can be easily and securely fixed on the printing cylinder for printing on an offset rotary printing press.

Materials of the printing plate used in this invention include various materials such as, for example, electrophotographic offset masters of zinc oxide-resin dispersion type, silver salt offset masters of silver complex diffusion transfer type, offset masters using photosensitive resins and direct-drawing type offset masters and this invention is not limited to these examples.

The papers and synthetic resin film supports used for the printing plate include, for example, paper, resin-coated papers (e.g., papers coated with polyethylene on both sides) and synthetic resin films (e.g., polyethylene terephthalate, polystyrene, polypropylene and polyethylene-polyethylene terephthalate laminated film) and this invention is not limited to these supports.

What is claimed is:

1. A printing plate having a paper or a synthetic resin film as a support which is mounted on a printing cylinder of a rotary printing press for printing said printing plate having two end parts and having perforations located in both end parts along which said printing plate is folded when it is mounted on said printing cylinder.

2. A method for mounting a printing plate having a synthetic resin film as a support on an offset rotary printing press, having a printing cylinder with a holding slit and a gripping rod in said slit, said gripping rod having a slit therein, said printing plate having two end parts, each of the two end parts of the printing plate being positioned in said holding slit of said printing cylinder and one of said end parts being in said slit of said gripping rod, comprising the following steps:

A. Perforating intermittently the entire width of each of said two end parts of said printing plate along lines corresponding to said holding slit of said printing cylinder and said slit of said gripping rod, respectively;

B. folding each of said two end parts of the printing plate along said perforated lines to form hooked portions;

C. mounting the printing plate on the printing cylinder by inserting said hooked portions of said printing plate into said holding slit of said printing cylinder and one of said hooked portions of said printing plate also into said slit of said gripping rod; and D. fixing said printing plate on said printing cylinder by rotating the gripping rod to stretch the printing plate.

3. A method according to claim 2 wherein the perforations are completely perforated.

4. A method according to claim 2 wherein the perforations are not completely perforated.

5. A method according to claim 2, wherein said gripping rod is subjected to a surface-working at least in the portion which contacts with the printing plate to provide this portion with frictional force.

6. A method according to claim 5 wherein the surface-working of the gripping rod comprises knurling.

7. A method according to claim 5 wherein the surface-working comprises a coating with rubber.

8. A method for forming folded hooked portions at both end parts of a printing plate having a synthetic resin film as a support for mounting the printing plate on a printing cylinder of a rotary printing press, comprising the following steps:

A. providing a printing plate having a synthetic resin film as a support;

B. making perforations adjacent each end of the printing plate along lines that are to be folded; and C. folding said ends of the printing plate along the perforated lines to form a hooked portion at each end of said printing plate.

9. A method for mounting a printing plate having a synthetic resin film as a support on an offset rotary printing press, having a printing cylinder with a holding slit and a gripping rod in said slit, said gripping rod having a slit therein, said printing plate having two end parts, each of two end parts of the printing plate being positioned in said holding slit of said printing cylinder and one of said end parts being in said slit of said gripping rod, comprising the following steps:

A. Perforating intermittently the entire width of each of said two end parts of said printing plate along lines corresponding to said holding slit of said printing cylinder and said slit of said gripping rod, respectively;

B. folding each of said two end parts of the printing plate along said perforated lines to form hooked portions;

C. mounting the printing plate on the printing cylinder by inserting said hooked portions of said printing plate into said holding slit of said printing cylinder and one said hooked portions of said printing plate also into said slit of said gripping rod;

D. fixing said printing plate on said printing cylinder by rotating the gripping rod to stretch the printing plate; and E. subjecting said gripping rod to surface-working at least in a portion which contacts with the printing plate to provide said portion with a frictional force.

* * * * *